United States Patent [19]

Ueki

[11] 4,022,639

[45] May 10, 1977

[54] METHOD FOR REMOVING CARBON SCALE

[75] Inventor: Hiroshi Ueki, Yokohama, Japan

[73] Assignee: Kurita Water Industries Ltd., Osaka, Japan

[22] Filed: July 10, 1975

[21] Appl. No.: 594,760

[30] Foreign Application Priority Data

July 24, 1974 Japan ..... 49-85383
Aug. 30, 1974 Japan ..... 49-99608

[52] U.S. Cl. ..... 134/2; 134/20; 134/22 R; 134/29; 134/30; 134/39; 201/2; 208/48 R

[51] Int. Cl.[2] ..... B08B 3/10; B08B 7/04; B08B 9/06

[58] Field of Search ..... 134/2, 20, 22 C, 29, 134/28, 30, 39, 22 R; 201/2; 208/48 R; 137/15

[56] References Cited

UNITED STATES PATENTS

| | | | |
|---|---|---|---|
| 140,590 | 7/1873 | Pitkin et al. | 201/2 |
| 2,419,076 | 4/1947 | Horsley | 201/2 X |
| 2,893,941 | 7/1959 | Kohfeldt et al. | 208/48 |
| 3,380,921 | 4/1968 | Goodspeed et al. | 134/28 X |
| 3,645,789 | 2/1972 | Mandelkow | 134/2 |

*Primary Examiner*—S. Leon Bashore
*Assistant Examiner*—Richard V. Fisher
*Attorney, Agent, or Firm*—Woodhams, Blanchard and Flynn

[57] ABSTRACT

A method for removing carbon scale, comprising permeating carbonate or bicarbonate into the carbon scale formed on a metal surface of a heating furnace, reactor or the like in a chemical plant by bringing the former into contact with the latter and decomposing the thus treated scale through oxidation by applying heat.

12 Claims, No Drawings

METHOD FOR REMOVING CARBON SCALE

BACKGROUND OF THE INVENTION

1. Field of the Invention

The present invention relates to a method for removing carbon scale, or the so-called coke, which is apt to be formed in heating furnaces and reactors in chemical plants of the petrochemical industry, coal-chemical industry, etc.

2. Description of the Prior Art

In removing the carbon scale formed on the inside surface of material heating furnaces, or reactors such as the preheating portion or the reaction tube of a naphtha cracking system connected to the ethylene manufacturing equipment in a petrochemical factory, the conventional decoking method comprising introducing steam and air to the portion where the scale is formed while heating the body of the furnace or reactor up to a temperature of from 500° to 700° C or thereabouts and thereby oxidizing the scale has been prevalent. In addition to this, the so-called hydrojet method wherein high-pressure water is blown against the scale through a nozzle thereby to exfoliate and remove the scale has also been adopted.

However, all these conventional methods involve various troubles. For instance, in the case of the decoking method employing the process of heat treatment at high temperature, there is a fear of causing damage to the furnace or reactor arising from the corrosion of the metallic material constituting the structure due to the high temperature. Besides, depending on the quality of the material of which the structure is built, it frequently happens that a method of treating at a high temperature such as from 500° to 700° C is inapplicable from the view point of the resistance to corrosion of the material. Moreover, in the method of treating at such a high temperature as above, the processes of heating and controlling the temperature while avoiding infliction of damage on the structure and controlling the quantity of steam blown in, the dampness and other conditions for treatment are attended with considerable technical difficulties.

In the case of the hydrojet method, it is impossible to remove the scale formed in the bent tube portion as well as the following portion, and therefore, the reliability of its effect remarkably decreases depending on the structure of the plant. Besides, there are instances wherein the hardness of the carbon scale and the strength of the adhesion thereof render the removal of said scale impossible. In addition, the hydrojet method causes secondary problems with respect to the treatment of waste water that is discharged, disposal of the scale that is discharged thereby, and so on.

SUMMARY OF THE INVENTION

The present invention provides a method for facilitating the removal of carbon scale for which the conventional methods have been disqualified for various reasons, said method comprising the steps of bringing the carbon scale into contact with a compound selected from the group consisting of carbonates and bicarbonates thereafter, oxidizing and decomposing the scale by heating.

DESCRIPTION OF THE PREFERRED EMBODIMENTS

The present invention provides a method effective for the removal of carbon scale containing hydrocarbons with advanced carbonization which scale is adhering to, for instance, a furnace and reactor of the naphtha cracking system for use in manufacturing ethylene, a heating furnace and reactor for butadiene manufacturing apparatus, a cracking furnace for use in manufacturing gas, a heating furnace of apparatus for manufacturing benzene, toluene and xylene, a heating furnace and cracking reactor for use in cracking manufacturing, a tar heating furnace and decomposing furnace, a tar acid distilling column, and a benzene scrubber.

In the present invention, as the compound to be brought into contact with the carbon scale, a carbonate or a bicarbonate which turns into a carbonate when subjected to heating is applicable, and particularly a carbonate is desirable. As the applicable salts, there are the sodium, potassium, silver, ammonium and amine carbonates and bicarbonates. In this connection, ammonium carbonate is in equilibrium with ammonium carbonate so that it is also included in the carbonate applicable to the present invention. Among these salts, the alkali metal salts are particularly desirable because of their superior water solubility.

The foregoing chemical agents are brought into contact with the carbon scale in the form of a 0.1 to 20% (by weight) aqueous solution, preferably a 5 to 10% aqueous solution, thereof for permeation into the scale. The chemical agent to be permeated into the scale can be a single member of the above cited chemical agents; but it also will do to apply two of them jointly, and in this case the scale-removing effect can be improved by permeating one chemical agent therein in advance and then permeating the other chemical agent.

The permeation of the chemical agent into the scale through contact and heating of the scale may be conducted simultaneously; but it is preferable to permeate the chemical agent into the scale in advance to ensure a sufficient permeation, and for this purpose, the chemical agent is kept in contact with the scale for 1 to 48 hours, preferably more than 6 hours, in advance. Besides, the joint use of a surface active agent as a wetting agent at the time of effecting permeation of the chemical agent into the scale is advisable as it will expediate a sufficient permeation. As the surface active agent various ones can be applied, for instance, alkyl ether-type surface active agent, alkyl aryl ether-type surface active agent, etc. Further, any of the nonionic surface active agents, anionic surface active agents and cationic surface active agents is applicable.

Moreover, the contact between the scale and the chemical agent may effected either at room temperature or at an elevated temperature; but it is preferable to effect the contact at an elevated temperature of 50° to 80° C or thereabouts as it will expediate the permeation of the chemical agent into the scale. In order to oxidize the scale by heating, air or oxygen is supplied to the body of the reactor or furnace or the metal tube whereon the scale is formed while heating the scale. The heating of the scale may be conducted either by directly heating with a burner, or by blowing superheated steam into the body of the reactor, furnace or the metal tube, or by applying these means jointly. This heating in the present invention suffices to be in the range of from 200° to 500° C or thereabouts, preferably from 250° to 450° C. The supply of oxygen is performed through natural ventilation when the scale-adhering portion communicates with the atmosphere, but when the portion having adhering scale is poorly ventilated, forced ventilation of air or oxygen is conducted. The time for the oxidation by heating is determined according to the quantity of the adhering scale; normally, it is desirable to effect the oxidation by heating for 1 to 24 hours, preferably more than 5 hours.

By virtue of the treatment as described above, the carbon scale formed on the surface of the metal is oxidized, burnt, decomposed and gasified. When the scale consists substantially of carbonaceous matter, no residue of the scale remains after the treatment, but when the scale contains some inorganic matters, these inorganic matters remain after the treatment. However, inasmuch as the greater part of the carbon content has been removed, the residue is very fragile and is in the state of being almost exfoliated from the wall surface of the body of the reactor, furnace or metal tube so that it can be readily removed and discharged by blowing steam or air against it. As described above, the present invention is intended to remove the scale by burning it, and the employment of a carbonate or the like lowers the combustion temperature on this occasion, and accordingly the scale-removing effect is substantially different from a mere breaking.

According to the present invention, by virtue of bringing the aforesaid specific chemical agent into contact with the carbon scale and permeating it therein, despite the relatively low temperature for heating required for oxidation of scale, the object of the invention can be achieved satisfactorily. Therefore, the treatment can be performed without causing any corrosion of the metallic material constituting the structure and at a considerably low combustion temperature, so that the heating and the control of temperature can be effected very easily. Besides, inasmuch as the scale is completely oxidized, the carbonaceous ingredients thereof are released in the form of a gas harmless to man and beast, and the inorganic ingredients thereof turn into oxides of sufficiently advanced oxidation that they can be recovered very easily for disposal, and there is no fear of the occurrence of public nuisances ascribable to waste materials arising from washing thereof. The method according to the present invention not only is superior in workability as stated above but also can be called an excellent method from the view point of after-treatment and prevention of public nuisances.

EXAMPLE 1

Ceramic Raschig rings (inner diameter: 26 mm, length: 40 mm) charged in a tar acid distilling column and having their interiors completely blocked up with carbon scale were treated by heating in an electric furnace after subjecting the rings to pretreatment with a carbonate. Then, by conducting natural ventilation by means of the gap in the wall of said electric furnace, removal of the scale from the rings was performed. The ingredients of the scale on this occasion were as shown in the following Table-1, and the condition of change of the scale was as shown in Table-2.

Table 1

| Ingredients of Scale | Substances lost on Ignition | $Fe_2O_3$ | $SiO_2$ | CuO NiO | $SO_3$ $P_2O_5$ |
|---|---|---|---|---|---|
| Content (%) | 99 | trace | 0.6 | trace | trace |

Table 2

| Test No. | Condition for Pretreatment: name of chem. agent | concentration (%) | temperature (° C) | time (hrs) | Condition for Heat Treatment (with electric furnace): temperature (° C) | time (hrs) | condition for ventilation | Condition of Scale |
|---|---|---|---|---|---|---|---|---|
| 1 | No pretreatment with chemical agent. | | | | 250 | 15 | natural ventilation | Scale contracted slightly. |
| | | | | | 275 | 15 | " | Reducing of scale to ashes advanced. |
| | | | | | 300 | 15 | " | Scale was turned into ashes completely. |
| | | | | | | 15 | | |
| 2 | sodium hydroxide | 10 | 80 | 15 | 250 | 15 | natural ventilation | Contraction of scale advanced. |
| | | | | | 275 | 15 | " | Reducing of scale to ashes advanced. |
| 3 | sodium carbonate | 10 | 80 | 15 | 225 | 15 | " | Scale began to be turned into ashes. |
| | | | | | 250 | 15 | " | Scale was turned into ashes completely. |

EXAMPLE 2.

Carbon scale adhering to the interior of the light oil heater tube of a petrochemical factory was taken out and divided into lumps of about 25 mm × 25 mm × 35 mm each. Then, after subjecting several bunches of said lumps to permeation with various chemical agents in advance while omitting said permeation treatment for another bunch of lumps, all the bunches were treated by heating in an electric furnace, and oxidation of the scale by heating was conducted under both conditions of natural ventilation and forced ventilation by way of the gap in the furnace wall of said electric furnace. The result was as shown in the following Table-3.

Table 3

| Test No. | Condition for Pretreatment: name of chem. agent | concentration (%) | temperature (20 C) | time (hrs) | Condition for Heat Treatment (with electric furnace): temperature (° C) | time (hrs) | condition for ventilation | Condition of Change of Scale |
|---|---|---|---|---|---|---|---|---|
| 1 | No pretreatment with chemical agent. | | | | 400 | 12 | natural ventilation | Change of color of a portion of scale into brown progressed, but no collapse was observed. |
| | | | | | 495 | 12 | " | Scale became reddish brown, and was ready to collapse. |
| 2 | sodium hydroxide | 10 | 105 | 24 | 450 | 12 | " | Scale became reddish brown, and was ready to collapse. |
| 3 | sodium carbonate | 5 | 105 | 24 | 375 | 12 | " | Scale became reddish brown, and was ready to collapse. |
| 4 | ammonium carbonate | 5 | 60 | 20 | 375 | 12 | natural ventilation | Scale became reddish brown, and was ready to collapse. |
| | | | | | 375 | 12 | forced ventilation | Scale became reddish brown, and was apt to collapse naturally. |
| 5 | silver carbonate | 0.1 | 60 | 15 | 375 | 12 | natural ventilation | Scale became reddish brown, and was ready to collapse. |

EXAMPLE 3.

A mixture consisting of charcoal powder and a chemical agent at the ratio of 2:1 by weight was kneaded in a mortar by adding distilled water in an amount equivalent to ⅓ by weight of the mixture. Test pieces of mild steel and stainless steel was put on this kneaded mixture by bringing one side of each piece into close contact with the mixture, and was subjected to treatment by heating in an electric furnace. The condition of the resultant corrosion of the steel materials was as shown in the following Table-4.

Table 4

| Test No. | Chemical Agent for Pretreatment mixed with Charcoal Powder: name of chemical agent | concentration (%) | Condition for Heat Treatment (with electric furnace): temperature (° C) | time (hrs) | condition for ventilation | Amount of Corrosion (mg/cm²) mild steel / stainless steel |
|---|---|---|---|---|---|---|
| 1 | No pretreatment with chemical agent | — | 450 | 12 | forced ventilation | 4.4 / 0 |
| 2 | sodium carbonate | 25 | 350 | 12 | " | 1.7 / 0 |
| 3 | ammonium carbonate | 25 | 350 | 12 | " | 0.9 / 0 |

EXAMPLE 4.

The scale collected from the interior of a naphtha cracking heater tube for use in manufacturing ethylene was divided into lumps of about 25 mm × 25 mm × 35 mm each. Then, after subjecting several bunches of said lumps to treatment with carbonate in advance while omitting such treatment for another bunch of lumps, all the bunches were treated by heating in an electric furnace, and oxidation of the scale by heating was conducted under both conditions of natural ventilation and forced ventilation by way of the gap in the furnace wall of said electric furnace. The ingredients of the scale used on this occasion were as shown in the following Table-5, and the condition of change of the scale was as shown in Table-6.

Table 5

| Ingredients of Scale | substances lost on ignition * | $Fe_2O_3$ | $SiO_2$ | CuO NiO | $SO_3$ $P_2O_5$ |
|---|---|---|---|---|---|
| Content (%) | 66.7 | 28.1 | 1.0 | trace | trace |

* This loss was equivalent to the content of organic matters, carbon, etc.

The present scale was in the form of black-colored lumps and therefore was judged to be a carbon scale.

Table 6

| | Condition for Pretreatment: name of chem. agent | concentration (%) | temperature (° C) | time (hrs) | Condition for Heat Treatment (with electrical furnace): temperature (° C) | time (hrs) | condition for ventilation | Condition of Scale |
|---|---|---|---|---|---|---|---|---|
| Comparative Example | No pretreatment with chemical agent | | | | 300 | 12 | natural ventilation | Scarcely changed. |
| | | | | | 350 | 12 | " | Color of a portion of scale changed into brown. |
| | | | | | 450 | 12 | " | Scale became reddish brown and began to be apt to collapse. |
| Compar- | sodium | 5 | 105 | 24 | 300 | 12 | natural | |

Table 6-continued

| | name of chem. agent | Condition for Pretreatment concen-tration (%) | temper-ature (° C) | time (hrs) | Condition for Heat Treatment (with electrical furnace) temper-ature (° C) | time (hrs) | condition for ventilation | Condition of Scale |
|---|---|---|---|---|---|---|---|---|
| ative Example | hydrox-ide | | | | | | ventilation | Scarcely changed. |
| | | | | | 400 | 12 | " | Change of color into brown advanced. |
| | | | | | 450 | 12 | " | Scale became reddish brown, and was ready to collapse. |
| Present Example | sodium carbon-ate | 5 | 105 | 24 | 300 | 12 | " | Scale changed its color into brown, and became a little lighter. |
| | | | | | 350 | 12 | " | Scale became reddish brown, and was ready to collapse. |
| Present Example | ammonium carbon-ate | 5 | 60 | 24 | 300 | 15 | forced ventilation | Scale changed its color into brown, and became a little lighter. |
| | | | | | 350 | 15 | " | Scale became reddish completely, and was ready to collapse. |
| | | | | | 350 | 15 | natural ventilation | Scale became reddish brown, and was ready to collapse. |

EXAMPLE 5.

The same scale as that in Example 4 was mixed with carbonate at the ratio of 10:1 by weight and was crushed. Then, by subjecting the thus crushed mixture to heating in an electric furnace while keeping it in close contact with test pieces of mild steel and stainless steel, respectively, the amount of corrosion of each piece was examined. The result was as shown in the following Table-7.

Table 7

| Name of chemical agent | Condition for Heat Treatment temperature (° C) | time (hrs) | condition for ventilation | Amount of Corrosin (mg/cm²) stain-less steel | mild steel |
|---|---|---|---|---|---|
| No pretreatment with chemical agent | 450 | 15 | forced ventilation | | 4.6 / 0 |
| sodium carbonate | 350 | 15 | " | | 1.8 / 0 |
| ammonium carbonate | 350 | 15 | " | | 0.8 / 0 |

EXAMPLE 6.

After stopping the operation of a naphtha cracking plant for use in manufacturing ethylene which had been at work in a petrochemical factory, a solution prepared by adding 0.1% of alkyl ether-type nonionic surface active agent as the wetting agent to a 10% solution of ammonium carbonate for industrial use was filled in the heater tube process side of said plant and was left standing at 60° C for 24 hours thereby to effect a thorough permeation of ammonium carbonate into the scale formed in the interior of said heater tube system. Subsequently, the residual ammonium carbonate was discharged to the outside of the system and then the heater tube was held at a temperature of from 280° to 300° C for 24 hours while introducing a mixture of superheated steam and air into the system to effect ventilation. During said ventilation, the other end of the heater tube of the cracking plant was opened to the atmosphere so as to exhaust the components of the scale collapsed by oxidation or exfoliated to the outside of the system.

After finishing the treatment, by the use of a $\gamma$-ray tester, the condition of removal of the scale was examined. As a result, it was found that all the scales including one formed in the bent tube portion which had been impossible to remove were removed almost completely. And, from the open end of the heater tube was released a reddish-brown waste material.

What is claimed is:

1. A method for removing adherent carbon-containing scale from an object, which consists essentially of the steps of: contacting said scale with a 0.1 to 20 weight percent aqueous solution of a substance selected from the group consisting of ammonium carbamate and sodium, potassium, silver, ammonium and amine carbonates and bicarbonates, for a first period of time effective to permeate said solution into said scale; then removing the remaining solution from contact with said scale; then heating the scale to a temperature in the range of from 200° to 500° C and simultaneously circulating past said scale and in contact therewith a stream of air or gaseous oxygen, for a second period of time effective to oxidize the carbon in said scale and to transform it to a gas so that it is removed from said object.

2. A method according to claim 1, wherein said first period of time is from 1 to 48 hours.

3. A method according to claim 1, wherein said first period of time is from 6 to 48 hours.

4. A method according to claim 1, wherein said solution contains a surface active agent.

5. A method according to claim 1 including the step of circulating superheated steam into contact with said scale simultaneously with the circulation of the stream of air or oxygen.

6. A method according to claim 1, wherein said substance is sodium, potassium, silver, ammonium or amine carbonate.

7. A method according to claim 1, wherein said substance is sodium, potassium or ammonium carbonate.

8. A method according to claim 1, wherein said second period of time is from 1 to 24 hours.

9. A method according to claim 1, wherein said second period of time is from 5 to 24 hours.

10. A method according to claim 1, wherein said scale is heated at a temperature in the range of from 250° to 450° C.

11. A method according to claim 1, wherein the scale is a carbon scale formed in the reactor and/or the furnace of a naptha cracking system.

12. A method according to claim 1 wherein said scale is heated at about 50° to 80° C when it is contacted by said solution, said solution contains from 5 to 10 weight percent of said substance, said substance is selected from the group consisting of sodium carbonate, potassium carbonate and ammonium carbonate, said first period of time is from 6 to 48 hours, said second period of time is from 5 to 24 hours, and said temperature is from 250° to 450° C.

* * * * *